US006497208B2

(12) United States Patent
Miyasaka

(10) Patent No.: US 6,497,208 B2
(45) Date of Patent: Dec. 24, 2002

(54) VARIABLE VALVE CONTROL APPARATUS FOR AN INTERNAL COMBUSTION ENGINE

(75) Inventor: Hideyuki Miyasaka, Kanagawa-ken (JP)

(73) Assignee: Unisia Jecs Corporation, Kanagawa-ken (JP)

( * ) Notice: Subject to any disclaimer, the term of this patent is extended or adjusted under 35 U.S.C. 154(b) by 0 days.

(21) Appl. No.: 09/884,075

(22) Filed: Jun. 20, 2001

(65) Prior Publication Data

US 2001/0054405 A1 Dec. 27, 2001

(30) Foreign Application Priority Data

Jun. 22, 2000 (JP) ..... 2000-187427

(51) Int. Cl.[7] ..... F01L 1/34

(52) U.S. Cl. ..... 123/90.17; 123/90.15; 123/90.31; 464/1; 464/2; 464/160

(58) Field of Search ..... 123/90.15, 90.17, 123/90.31; 464/2, 1, 160

(56) References Cited

U.S. PATENT DOCUMENTS

| | | | | |
|---|---|---|---|---|
| 5,549,081 A | * | 8/1996 | Ohlendorf et al. | 123/90.16 |
| 5,816,204 A | * | 10/1998 | Moriya | 123/90.17 |
| 5,823,152 A | | 10/1998 | Ushida | 123/90.17 |
| 5,832,887 A | | 11/1998 | Adachi et al. | 123/90.15 |
| 6,170,448 B1 | * | 1/2001 | Askura | 123/90.18 |
| 6,199,524 B1 | * | 3/2001 | Ushida | 123/90.17 |
| 6,244,230 B1 | * | 6/2001 | Mikame | 123/90.17 |
| 6,247,434 B1 | * | 6/2001 | Simpson et al. | 123/90.17 |
| 6,311,665 B1 | * | 11/2001 | Simpson et al. | 123/90.17 |
| 6,311,667 B1 | * | 11/2001 | Satou et al. | 123/295 |
| 6,394,052 B2 | * | 5/2002 | Miyasaka et al. | 123/90.17 |

FOREIGN PATENT DOCUMENTS

| | | | |
|---|---|---|---|
| JP | 9-280018 | | 10/1997 |
| JP | 10115203 A | * | 5/1998 |
| JP | 10-159515 | | 6/1998 |
| JP | 10212911 A | * | 8/1998 |
| JP | 11002108 A | * | 1/1999 |
| JP | 11002109 A | * | 1/1999 |
| JP | 11081927 A | * | 3/1999 |
| JP | 11182214 A | * | 7/1999 |
| JP | 11-264303 | | 9/1999 |

* cited by examiner

*Primary Examiner*—Thomas Denion
*Assistant Examiner*—Ching Chang
(74) *Attorney, Agent, or Firm*—Sughrue Mion, PLLC

(57) ABSTRACT

A variable valve timing control apparatus for an internal combustion engine comprising a housing member rotated in synchronism with one of a first shaft and a second shaft, the housing member comprising a circular space provided therein and at least one fan-shaped space radially extending from an outer circumferential surface of the circular space, a vane rotor rotated in synchronism with the other of the first shaft and the second shaft, the vane rotor is accommodated in the housing member in order to relatively rotate with respect to the housing member, the vane rotor comprising at least one vane radially extending so as to divide each the fan-shaped space into a first chamber and a second chamber, a locking member provided in one of the housing member and the vane, the locking member comprising a main body portion provided with a cylindrical shape and a leading head portion provided with a tapered surface whose diameter decreases toward an end face of the leading head portion, an engaging bore provided in the other of the housing member and the vane for accommodating the leading head portion, a diameter at the opening of the engaging bore being larger than a diameter at the end face of the leading head portion, and smaller than a diameter at which the leading head portion has a largest diameter.

21 Claims, 8 Drawing Sheets

VARIABLE VALVE CONTROL APPARATUS FOR AN INTERNAL COMBUSTION ENGINE

BACKGROUND OF THE INVENTION

This invention relates to a variable valve timing control apparatus provided in an internal combustion engine (hereinafter referred to as "an engine") to change the valve timing of intake valves or exhaust valves, thereby changing operation timing of the intake valves or the exhaust valves in accordance with engine conditions. A variable valve timing control apparatus is proposed in an engine to displace the rotational phrase of a camshaft and adjust the valve timing of either an intake valve or an exhaust valve.

This type of apparatus is generally known. For example, relevant related art is disclosed in Japan publication (koukai) No. 9-280018, and Japan publication (koukai) No. 10-159515. These publications disclose a vane-type variable valve timing control apparatus (hereinafter referred to as "vane-type VTC" or simply "VTC") which has a housing member rotated by a crankshaft of the engine. The housing has a circular space and fan-shaped spaces protruding from circumferential surface of the circular space. A vane rotor is accommodated in the housing member and rotates in synchronism with a camshaft. There are plural vanes protruding from the circumferential surface of the vane rotor, each vane is accommodated in each fan-shaped space and defines an advancing hydraulic chamber and a retarding hydraulic chamber. Finally, there is a hydraulic actuating means for actuating hydraulic pressure in the advanced hydraulic chambers and the retarding hydraulic chambers. The hydraulic actuating means selectively supplies the hydraulic fluid to either the advancing hydraulic chambers or retarding hydraulic chambers and discharges the hydraulic fluid from the other of the advancing hydraulic chambers and retarding hydraulic chambers. Thereby the vane rotor is rotated relative to the housing.

The Japan publication No. 9-280018 further describes a locking mechanism for preventing a vane rotor from relatively rotating with respect to a housing. The locking member comprising a locking pin provided in a vane, and an engaging bore provided in the housing. When the engine is out of operation, or when the hydraulic pressure in the advancing hydraulic chambers or the retarding hydraulic chambers is under a predetermined value, a leading head portion of the locking pin is urged into an engaging bore by the urging force of a spring provided in the locking pin. As a result, an impinging sound that otherwise would be caused by the relative movement of the vanes and the housing member is prevented from being generated even if the camshaft undergoes positive or negative torque variation in driving the intake valves or exhaust valves, when the vanes are disposed at the most retarded position or the most advanced position in respect of the crankshaft. When the pressure in the advancing chambers or the retarding chambers is over the predetermined value by supplying hydraulic fluid to the advancing hydraulic chambers or the retarding hydraulic chambers, the leading head portion of the locking pin is retracted from the engaging bore and the vane rotor relatively rotates with respect to the housing member. The leading head portion and the engaging bore are both formed cylindrically.

However, since the both leading head portion and the engaging bore are formed cylindrically, a diameter of the engaging bore must be made larger than a diameter of the leading head portion of the locking pin in order that the leading head portion is accommodated positively in the engaging bore. As a result, a gap is made between the leading head portion and the engaging bore. This gap causes impinging between the leading head and the engaging bore by torque fluctuation of the camshaft undergoing the positive or negative torque variation.

The Japan publication No. 10-159515 also describes a locking pin of which the leading head portion is provided with a tapered surface, and an engaging bore provided with a tapered surface. Both taper angles correspond together.

However, since these tapers of the leading head portion and the engaging bore should be provided with precisely the same angle, it often is difficult to provide a taper angle of the leading head portion that corresponds to the taper angle of the engaging bore. If the taper angle of the engaging bore is larger than the taper angle of the leading head portion, a gap is provided between the entire outer surface of the leading head portion and the entire inner surface of the engaging bore. Thereby, the locking pin easily fits into the bore, thus allowing the leading head portion to be retracted from the engaging bore by torque fluctuation of the camshaft before the pressure in the advanced hydraulic chamber or the retarded hydraulic chambers reaches a predetermined value.

Even if the leading head portion of the locking pin and the engaging bore can be shaped so that the both taper angles correspond together, the torque fluctuation transmitted via the camshaft and the locking pin affects the whole surface of the engaging bore. This contact causes abrasion at the inner surface of the engaging bore. Thereby a gap is formed between the inner surface of the engaging bore and the outer surface of the leading head portion of the locking pin. Consequently, the locking pin may retract from the engaging bore by torque fluctuation of the camshaft before reaching the pressure in the advanced hydraulic chamber or the retarded hydraulic chambers to the predetermined value.

SUMMARY OF THE INVENTION

Accordingly, in view of above-described problems encountered in the related art, a principal object of the present invention is to provide a vane-type VTC which has a locking mechanism that is moved easily and consistently.

Another object of the present invention is to prevent the undesirable retraction of a locking member from an engaging bore.

Still another object of the present invention is to prevent the performance of the apparatus from degradation due to abrasion of the locking mechanism over time.

Yet another object of the present invention is to provide a locking mechanism having a locking member that is highly responsive.

In order to achieve these and other objects, there is provided a variable valve timing control apparatus for an internal combustion engine, having a first shaft and a second shaft, that comprises a housing member rotated in synchronism with one of the first shaft and the second shaft. The housing has a circular space provided inside of the housing and at least one fan-shaped space radially extending from an outer circumferential surface of the circular space, a vane rotor rotated in synchronism with the other of the first shaft and the second shaft and accommodated in the housing member in order to relatively rotate with respect to the housing member. The vane rotor has radially extending at least one vane so as to divide each the at least one fan-shaped space into a first chamber and a second chamber. There is a locking member provided in one of the housing member and the vane, the locking member having a leading head portion provided with tapered surface having a diameter that decreases toward an end face of the leading head portion. The locking member is movable in response to hydraulic pressure in the first hydraulic chamber or the second hydraulic chamber. There also is an engaging bore provided in the other of the housing member and the vane for accommodating the leading head portion, the engaging bore having an opening where the engaging bore accommodates the leading head portion. The diameter at the opening of the engaging bore is larger than a diameter at the end face of the leading head portion, and smaller than a diameter at a position where the leading head portion has the largest diameter.

Other aspects and advantages of the invention will become apparent from the following description, taken in conjunction with the accompanying drawings, illustrating by way of example the principals of the invention.

DETAILED DESCRIPTION OF THE PREFERRED EMBODIMENTS

A variable valve timing apparatus (vane-type VTC) according to a preferred embodiment of the present invention will now be described with reference to the drawings. According to the embodiment of the present invention, a vane-type VTC is provided on an intake camshaft, but easily can be provided on an exhaust camshaft.

Figure 1:
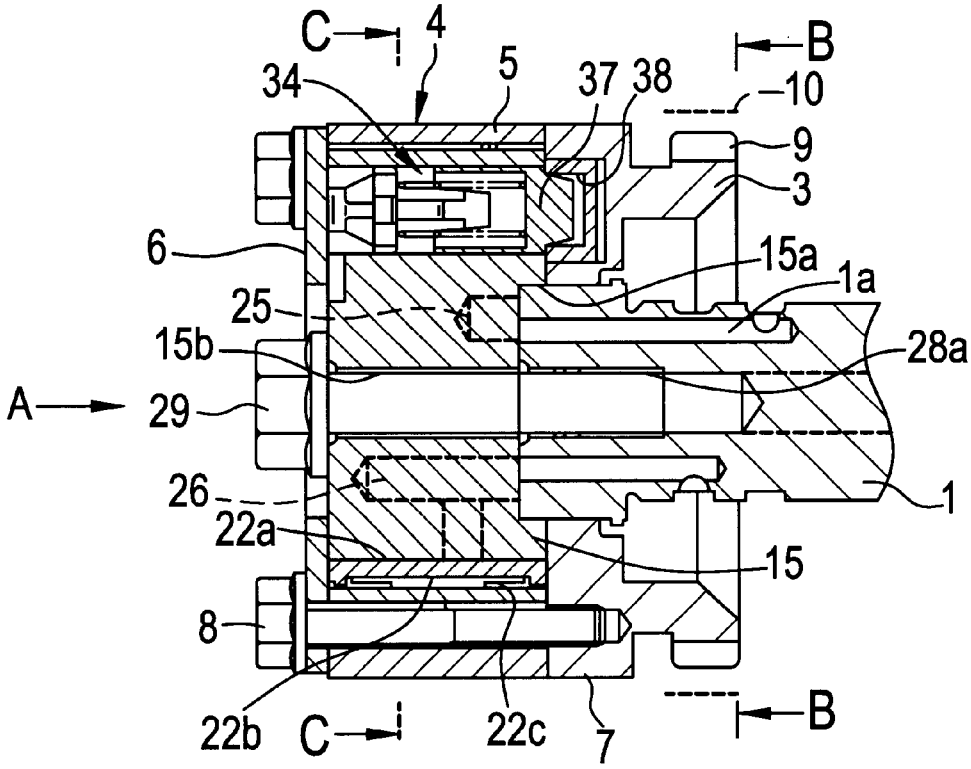
FIG. 1 is vertical sectional drawing, showing a variable valve timing control apparatus according to an embodiment of the present invention.
Figure 2:
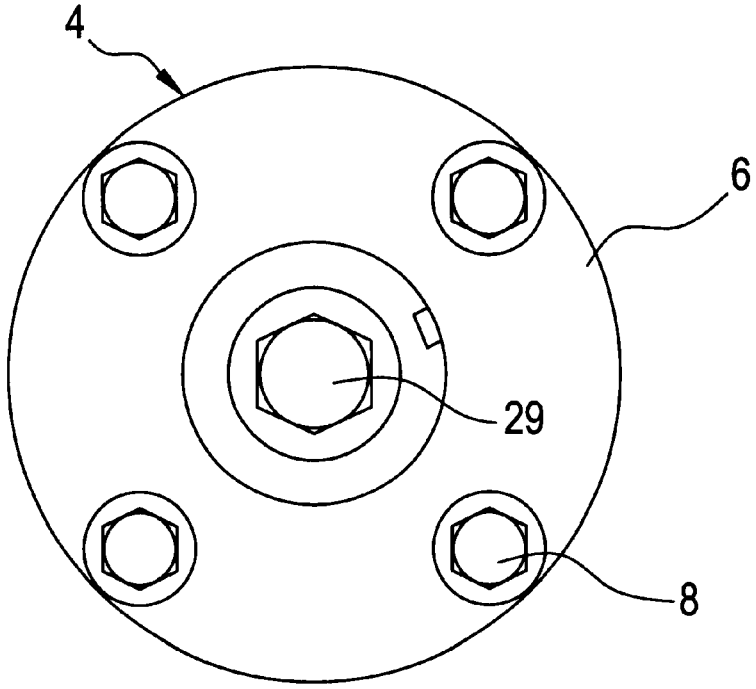
FIG. 2 is a side view taken from arrow A of FIG. 1.
Figure 3:
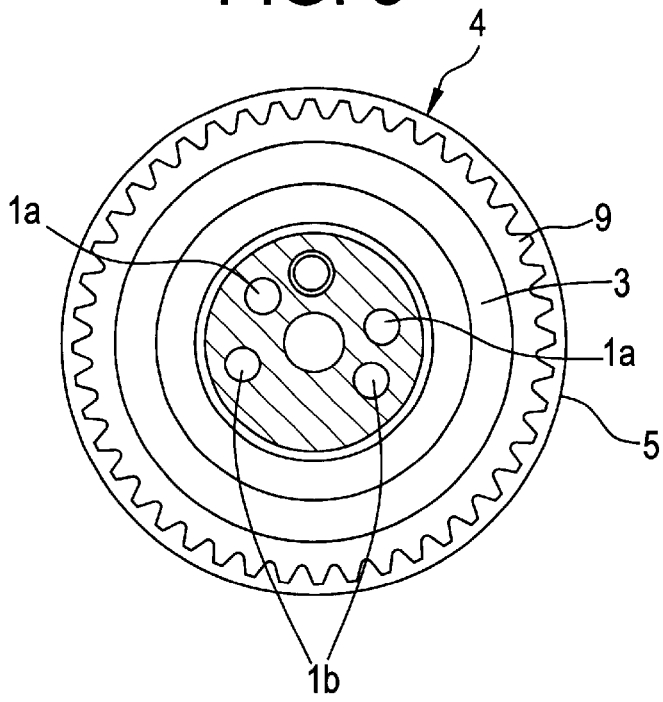
FIG. 3 is a sectional view taken on line B—B of FIG. 1.

As shown in FIGS. 1, 2 and 3, a camshaft 1 operates an intake valve (not shown) of an internal combustion engine.

The camshaft 1 is supported by a bearing (not shown) fixed on a cylinder head (not shown) of the engine and operates a cam (not shown) provided on the camshaft. The cam operates the intake valve. The camshaft 1 is rotated by a chain sprocket 3 which is rotated in synchronism with a crank shaft (not shown) of the engine.

A housing member 4 relatively rotates with respect to the camshaft 1. The housing member 4 comprises a main body 5 formed with a cylindrical shape and plate members 6 and 7, which close the two axial sides of the main body 5. The sprocket 3, the main body 5 and plate members 6 and 7 are fixed together by bolts 8.

Gear teeth 9 are provided on the outer circumferential surface of the sprocket 3. A timing chain 10 connects the crank shaft to the sprocket 3 for transmitting the engine revolution from the crank shaft to the camshaft 1.

Figure 4:
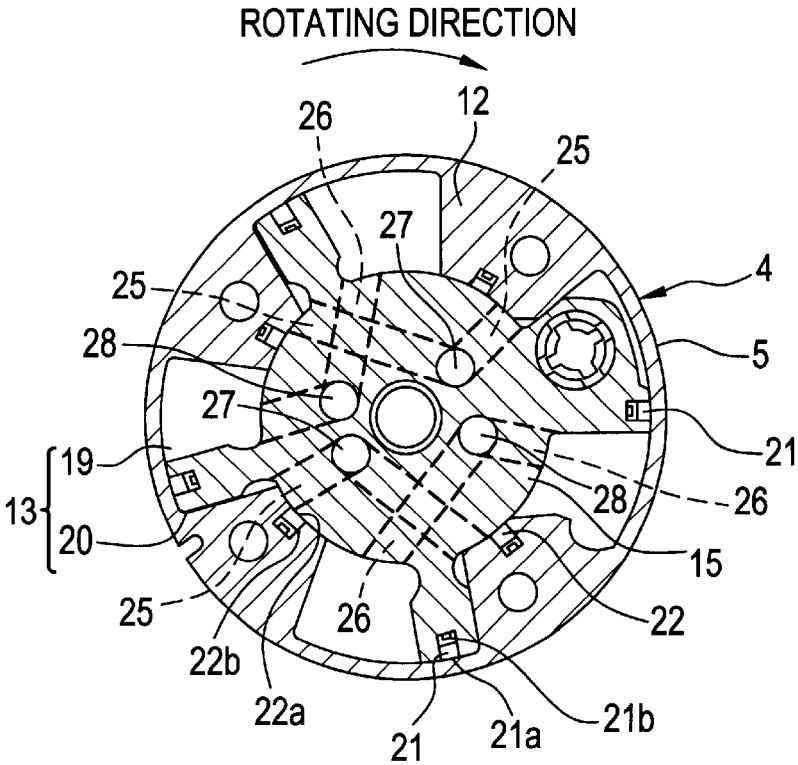
FIG. 4 is a sectional view taken on line C—C of FIG. 1.

As shown in FIG. 4, a circular space and plural shoes 12 are formed in the housing member 4. Each shoe 12 is protruding from the inner circumferential surface of the housing member 4, in order that a fan-shaped hydraulic chamber 13 is defined between each shoe 12. The fan-shaped hydraulic chambers 13 are connect to the circular space which is filled by a vane rotor 15. According to the first embodiment of the present invention, four shoes 12 and four hydraulic chambers 13 are provided. The vane rotor 15 is provided in the housing member 4 and has plural vanes 18 protruding from outer circumferential surface of the vane rotor 15. The vane rotor 15 is accommodated in the housing member 4 in order that each vane 18 is located in each fan-shaped hydraulic chamber 13 and that the vane rotor relatively rotates with respect to the housing member 4 within a range of predetermined angles.

Each vane 18 defines, in the corresponding the fan-shaped hydraulic chambers 13, an advancing hydraulic chamber 20 and a retarding hydraulic chamber 19. The advancing hydraulic chamber 20 is provided on the trailing side with respect to the rotating direction of the vane 18, while the retarding hydraulic chamber 19 is provided on the leading side.

As shown in FIG. 4, seal member 21 is provided on the outer circumferential surface of each vane 18. Each seal member 21 has a sealing surface 21*a* and a concave portion 21*b*. A spring 21*c*, formed in an arc shape, is provided in the concave portion 21*b* for urging the seal member toward inner circumferential surface of the fan-shaped hydraulic chamber 13. The spring 21*c* is prohibited from relatively moving with respect to the seal member 21 in an axial direction of the vane rotor 15.

As shown in FIGS. 1 and 4, seal member 22 is provided on the inner circumferential surface of each shoe 12. Each seal member 22 has a sealing surface 22*a* and a concave portion 22*b*. A spring 22*c*, formed in an arc shape, is provided in the concave portion 22*b* for urging the seal member toward the outer circumferential surface of the vane rotor 15. The spring 22*c* is prohibited from relatively moving with respect to the seal member 22 in an axial direction of the vane rotor 15.

Each sealing member 21 and 22 is made from metal, or elastic material, for example, synthetic resin, by molding, and is formed in an arc shape which has a large radius of curvature in an axial direction of the vane rotor 15. Each sealing surface 21*a* and 22*a* is formed in an arc shape toward the inner circumferential surface of the hydraulic chamber 13 and outer circumferential surface of the vane rotor 15, respectively.

Each spring 21*c* and 22*c* is made from metal, or elastic material, for example, synthetic resin. Thus, in the case where the springs 21*c* and 22*c* are made of the same material as the sealing members 21 and 22, the springs 21*c* and 22*c* can be formed integrally with the sealing members 21 and 22, respectively.

Therefore, each sealing member 21 and 22 prohibits the transference of hydraulic fluid between advancing hydraulic chamber 20 and retarding hydraulic chamber 19.

Next, hydraulic passages for supplying, or discharging, the hydraulic fluid to, or from, the advancing hydraulic chambers 20 and retarding hydraulic chambers 19 will be described.

As shown in FIGS. 1, 3 and 4, according to the first embodiment of the present invention, four first passages 25 and four second passages 26 are provided in the vane rotor 15 generally in the radial direction. Two third passages 27 and two fourth passages 28 are provided in the vane rotor in its axial direction. Two fifth passages 1*a* and two sixth passages 1*b* are provided in the camshaft 1.

Each first passage 25 has an opening which opens in each advancing hydraulic chamber 20. One end of each third passage 27 is connected every two first passages 25. The other end of each third passage 27 is connected to each fifth passage 1*a* at which the housing member 4 and the camshaft 1 are connected together. Therefore, two fifth passages 1*a* are provided in the camshaft 1.

Each second passage 26 has an opening which opens in each retarding hydraulic chamber 19. One end of each fourth passage 28 is connected every two second passages 26. The other end of each fourth passage 28 is connected to each sixth passage 1*b* at which the housing member 4 and the camshaft 1 are connected together. Therefore, two sixth passages 1*b* are provided in the camshaft 1.

The other end of the fifth passages 1*a* and sixth passages 1*b* are connected to the hydraulic source (not shown) and drain port (not shown) via the other passages (not shown) and a control valve (not shown). The control valve is operated by a controller (not shown), based on the engine condition, and selectively connects the hydraulic source to the fifth passages 1*a* or the sixth passages 1*b*. Thus, when either the fifth passages 1*a* or the sixth passages 1*b* are connected to the hydraulic source, the other of the fifth passages 1*a* and the sixth passages 1*b* are connected to the drain port by the control valve. Thereby, the hydraulic fluid is selectively supplied to, or discharged from, the advancing hydraulic chambers 20 or retarding hydraulic chambers 19.

As shown in FIG. 1, a concave portion 15*a* is provided on the side face of the vane rotor 15 for receiving an end face of the camshaft 1. The camshaft 1 is penetrating the plate member 7 and an end face of the camshaft 1 is connected to the vane rotor 15 at the concave portion 15*a* by a bolt 29 inserted into a hole 15*b* which is formed at the center of the vane rotor 15.

In short, since the sprocket 3 is connecting to the housing member 4 and the camshaft 1 is connecting to the vane rotor 15, the vane rotor 15 relatively rotates with respect to the housing member 4 by regulating hydraulic pressure in the advancing hydraulic chambers 20 and retarding hydraulic chambers 19. Therefore, the camshaft 1 relatively rotates with respect to the sprocket 3 within a range of predetermined angles.

Next, a locking mechanism 34 for fixing the vane rotor 15 to the housing member 4 will be described. As shown in FIGS. 1, 4, 5A, 5B and 5C, the locking mechanism 34 is provided in the housing member 4 and the vane rotor 15. The locking mechanism 34 comprises a locking pin 37, an engaging member 44, a spring 36, and a stopper member 39.

The locking pin 37 comprises a main body portion provided with cylindrical shape and a leading head portion 37*c* provided with tapered surface. The locking pin 37 is movably located in a hole 35 provided in a vane 18 whose width in the circumferential direction is wider than the other vanes 18 in an axial direction of the vane rotor. Thereby, the leading head portion 37*c* is accommodated in, or is retracted from, an engaging bore 38 provided in the engaging member 44. The engaging member is provided on the plate member 7.

Figure 5A:
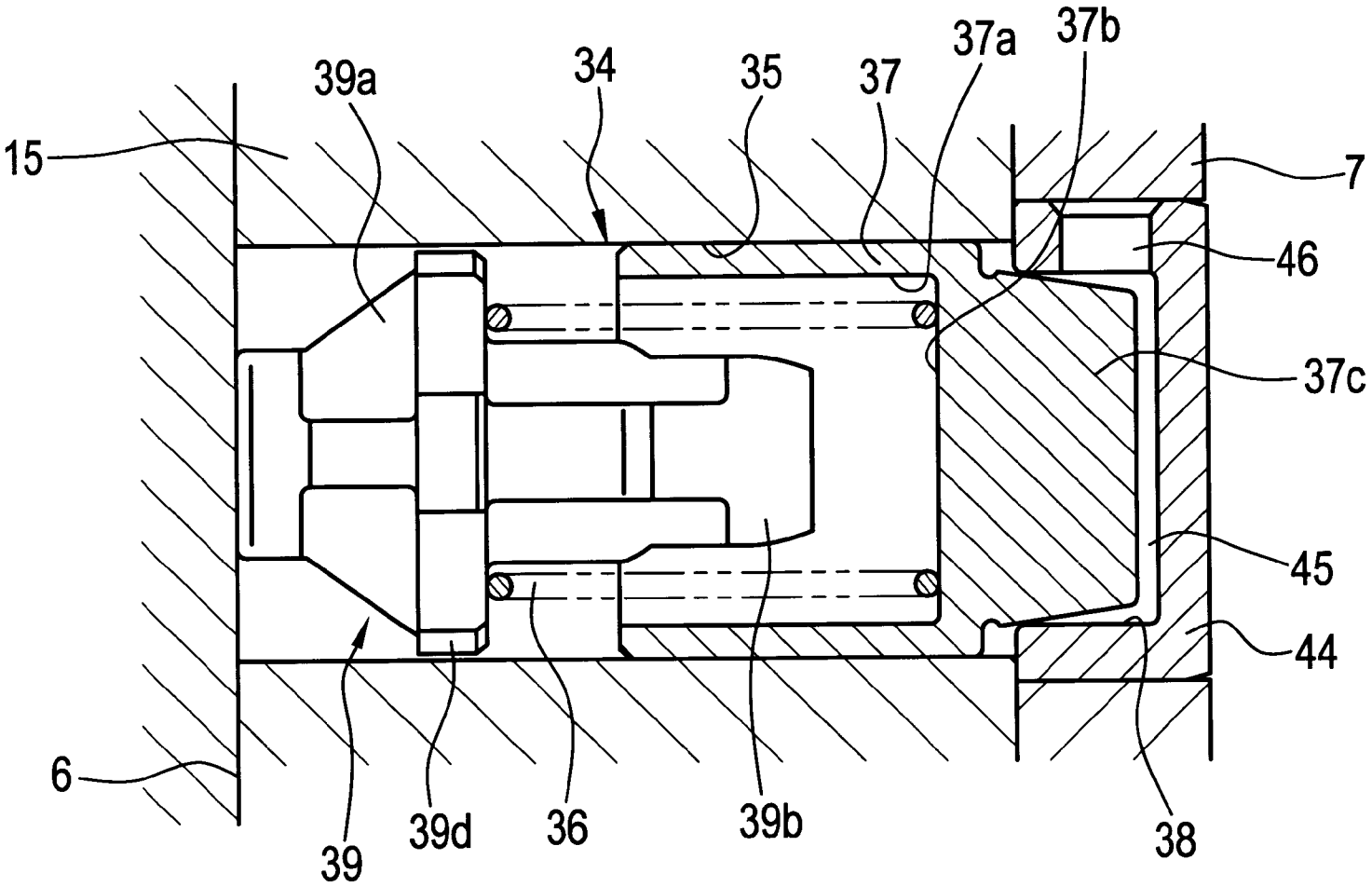
FIG. 5A is an enlarged sectional drawing, showing a locking member of the first embodiment of the present invention.
Figure 5B:
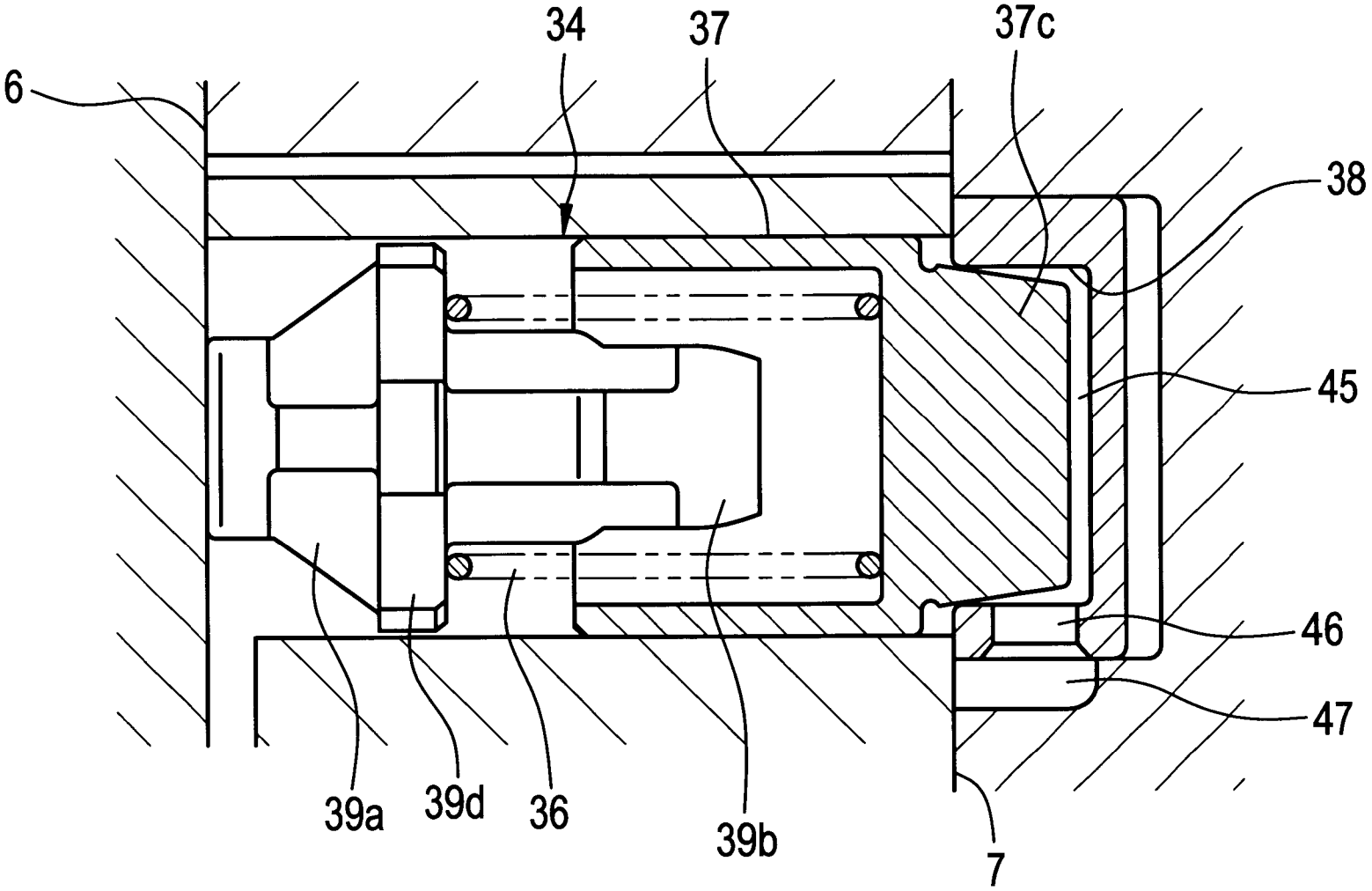
FIG. 5B is an enlarged sectional drawing, wherein the leading head portion of the locking member of FIG. 5A is accommodated in an engaging bore.
Figure 5C:
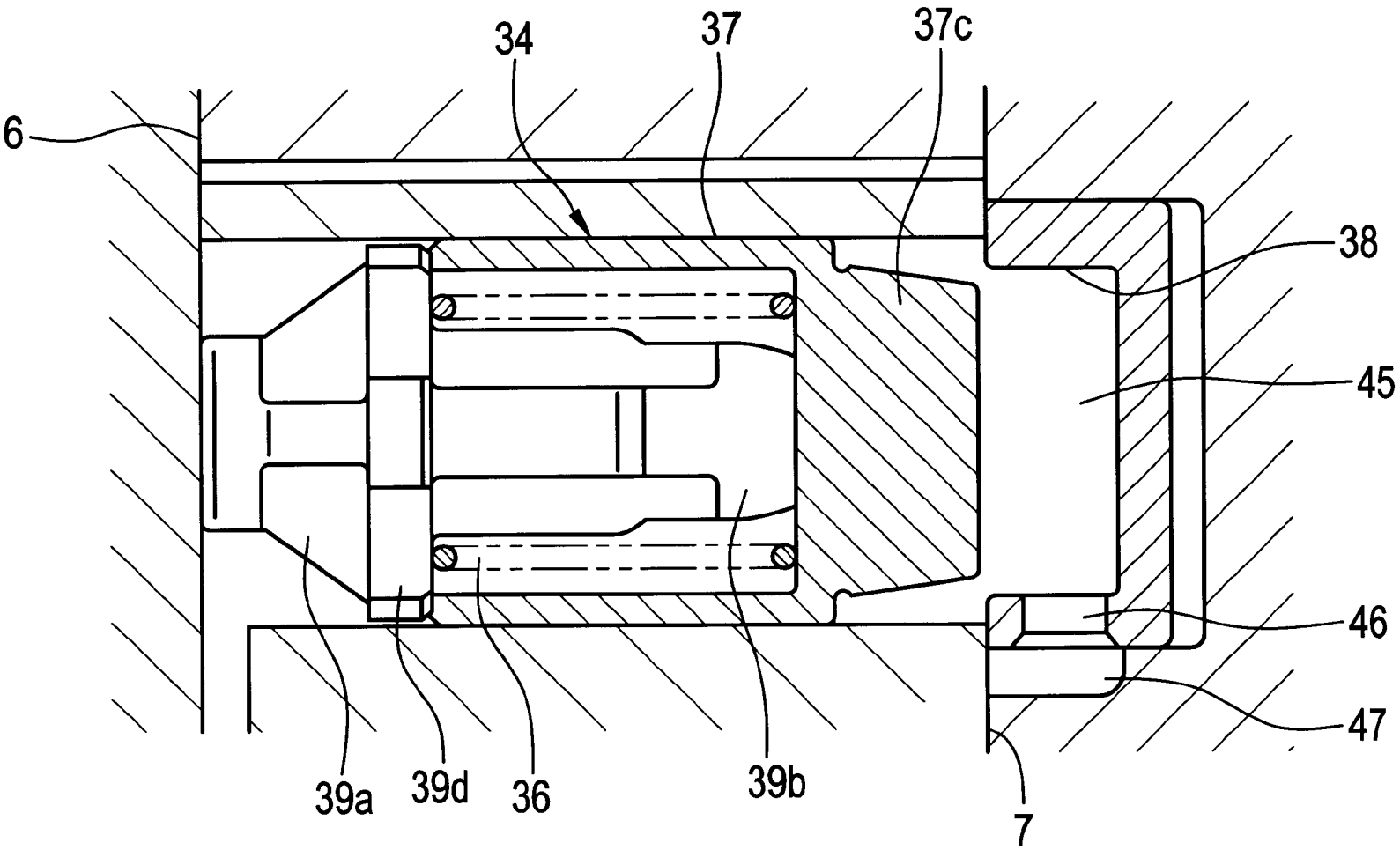
FIG. 5C is an enlarged sectional drawing, wherein the leading head portion of the locking member of FIG. 5A is retracted from an engaging bore.

As shown in FIGS. 5A, 5B and 5C, the stopper member 39 has, according to the direction from the plate member 6 to the plate member 7, a tapered portion 39*a*, a cylindrical portion 39*d* and a stopper portion 39*b*.

A hollow space portion 37*a* which opens toward the stopper member 39 is provided in the main body portion of the locking pin 37. One end of the spring 36 is supported by the stopper portion 39*b*. The other side of the spring 36 is accommodated in the hollow space portion 37*a* and is supported by a bottom surface 37*b* of the hollow space portion 37*a*. Therefore, the locking pin 37 is urged toward the plate member 7 by the spring 36. The stopper portion 39*b* restricts the movement of the locking pin 37 toward the plate member 6 when the leading head portion 37*c* is retracted from the engaging bore 38.

Plural notches 39*c* are provided on the outer circumferential surface of the cylindrical portion 39*d* for permitting air flow between the hollow space portion 37*a* and a space defined by the tapered portion 39*a*, the hole 35 and the plate member 6. One end of the tapered portion 39*a* touches the plate member 6. In other words, the plate member 6 supports the stopper member 39 urged by counter-force of the spring 36. According to the first embodiment of the present invention, the tapered portion 39*a* is protruding from the cylindrical portion 39*d*, and is formed in order that a diameter decreases toward the plate member 6 and an end face of the tapered portion 39*a* touches the plate member 6.

The leading head portion 37*c* is provided with a tapered surface, whose diameter decreases toward an end face of the leading head portion 37*c*, where it is accommodated in an engaging bore 38. An inner surface of the engaging bore 38 has a cylindrical shape.

The engaging member 44 is made from high-strength steel which has abrasion resistance, for example, surface-hardened alloy or quenched chromium-molybdenum steel, and is embedded in the plate member 7.

The leading head portion 37*c* and the engaging member 44 cooperatively define a hydraulic chamber 45 when the leading head portion 37*c* is accommodated in the engaging bore 38. The hydraulic chamber 45 is connected to the advancing hydraulic chamber 20 by a passage 46 and 47 provided on the engaging bore 44 and plate member 7, respectively.

As shown in FIG. 4, when the engine is out of operation or just after it has started to run, that is when the pressure in both of the advancing hydraulic chambers 20 and retarding hydraulic chambers 19 are low, or when the controller outputs, based on the engine condition, a control signal to keep the vane rotor 15 at the most retarded position with respect to the housing member 4, the vane rotor 15 is at the most retarded position with respect to the housing member 4. At this point, as shown in FIGS. 1 and 5A, the leading head portion 37*c* is accommodated in the engaging bore 38 and fixes the vane rotor 15 to the housing member 4. Thereby, a driving force is transmitted from the crankshaft to the sprocket 3 via the timing chain 10, the housing member 4, the locking pin 37, and vane rotor 15, and thus the camshaft 1 operates the intake valve. When the leading head portion 37*c* is accommodated in the engaging bore 38 by the urging force of the spring 36, the leading head portion 37*c* prevents the vane rotor 15 from relatively rotating with respect to the housing member 4 even if the camshaft 1, which is connected to the vane rotor 15, undergoes positive or negative torque variation in driving the intake valves or exhaust valves. Therefore, an impinging sound, which would be caused by the impingement between the vanes 18 and the shoes 12, is prevented.

Next, the advancing operation controlled by the controller will be described. When the controller outputs a control signal in order that the vane rotor 15 rotates relatively in an advancing direction with respect to the housing member 4, the controller operates the control valve in order that the hydraulic source supplies the hydraulic fluid to the advancing hydraulic chambers 20. At this point, the hydraulic fluid supplied to the advancing hydraulic chambers 20 is also supplied to the hydraulic chamber 45 via the passages 46 and 47.

As shown in FIG. 5C, the hydraulic pressure generated by the hydraulic fluid, which is supplied to the hydraulic chamber 45, urges the leading head portion 37*c* to retract from the engaging bore 44 until the bottom surface 37*b* touches the end face of the stopper portion 39*b* resisting the spring force of the spring 36. Thereby, the fixed relationship between the vane rotor 15 and the housing member 4 is released and the vane rotor 15 is able to rotate relatively with respect to the housing member 4 in a clockwise direction.

During the advancing operation, the hydraulic fluid is supplied to the advancing hydraulic chambers 20 and is discharged from the retarding hydraulic chambers 19. Thereby, the hydraulic fluid in the advancing hydraulic chambers 20 provides a force on the vane 18 that causes the vane rotor 15 to rotate relatively in clockwise direction with respect to the housing member 4. Therefore, the rotational phase of the camshaft 1 with respect to the crankshaft is changed, and the valve timing of the intake valve is changed.

Next, the retarding operation controlled by the controller will be described. When the controller outputs, based on the engine condition, a control signal in order that the vane rotor 15 rotates relatively in a retarding direction with respect to the housing member 4, the hydraulic fluid is supplied to the retarding hydraulic chambers 19 via the passages 1*b,* 28 and 26, and discharged from the advancing hydraulic chambers 20 via the passages 1*a,* 27 and 25. At this point, the spring force of the spring 36 urges the locking pin 37 toward the plate member 7. However, since the leading head 37*c* portion is accommodated in the engaging bore 38 at the most retarded position of the vane rotor 15 with respect to the housing member 4, the vane rotor 15 is able to rotate relatively with respect to the housing member 4.

While the hydraulic fluid is supplied to the retarding hydraulic chambers 19, the hydraulic fluid is discharged from the advancing hydraulic chambers 20. Thereby the hydraulic fluid in the retarding hydraulic chambers 19 provides a force on the vane 18 that causes the vane rotor 15 to rotate relatively with respect to the housing member 4 in a counterclockwise direction. Therefore, the rotational phase of the camshaft 1 with respect to the crankshaft is changed and the valve timing of the intake valve is changed.

When the vane rotor 15 is positioned at the most retarded position with respect to the housing member 4 by the retarding operation, the leading head portion 37*c* is accommodated in the engaging bore 38 by the spring force of the spring 36. At this point, as shown in FIGS. 5A and 5B, since the leading head portion 37*c* is provided with tapered surface so that a diameter of the leading head portion 37*c* decreases toward an end face of the leading head portion 37*c,* the leading head portion 37*c* is accommodated positively in the engaging bore 38. Further, since a diameter of the engaging bore 38 is provided in order that its diameter is larger than a diameter at the end face of the leading head 37*c,* and is smaller than a diameter at which the leading head portion 37*c* has the largest diameter, a tapered surface of the leading head portion 37*c* touches at the edge of the engaging bore 38. That is, the leading head portion 37*c* and the engaging bore 38 make a line contact together. Thereby, the engaging member 44 receives the torque fluctuation of the camshaft 1 via the vane rotor 15 and locking pin 37 only at a locus of points where the diameter of the engaging bore 38 becomes identical to the diameter of the leading head portion 37*c*. Therefore, an abrasion at the whole surface of the engaging bore 38 which causes undesirable retraction of the leading head portion 37*c* of the locking pin 37 from the engaging bore 38 is prevented.

Next, an intermediate operation controlled by the controller will be described. When the controller outputs, based on the engine condition, a control signal in order that the vane rotor 15 is at an intermediate position between the most retarded position and the most advanced position with respect to the housing member 4, the control valve disconnects the passages 1*a* and 1*b* to the hydraulic source and drain port and, thereby, the hydraulic pressure in all of the advancing chambers 20 and retarding chambers 19 is retained. Therefore, the vane rotor 15 is positioned at the intermediate position between the most advanced position and the most retarded position with respect to the housing member 4. As a result, the intake valve is operated, based on the engine condition, at the preferable timing by the camshaft 1.

During the intermediate operation, since the leading head portion 37*c* is accommodated in the engaging bore 38 at the most retarded position of the vane rotor 15 with respect to the housing member 4, the vane rotor 15 and the housing member 4 are not fixed and, thus, the vane rotor 15 is able to rotate relatively with respect to the housing member 4.

Next, the vane-type VTC according to a second embodiment of the present invention will be described, referring FIGS. 6A, 6B and 6C. Parts of this embodiment are given the same or similar reference characters to corresponding parts of the first embodiment, and only differences from the first embodiment will be described.

Figure 6A:
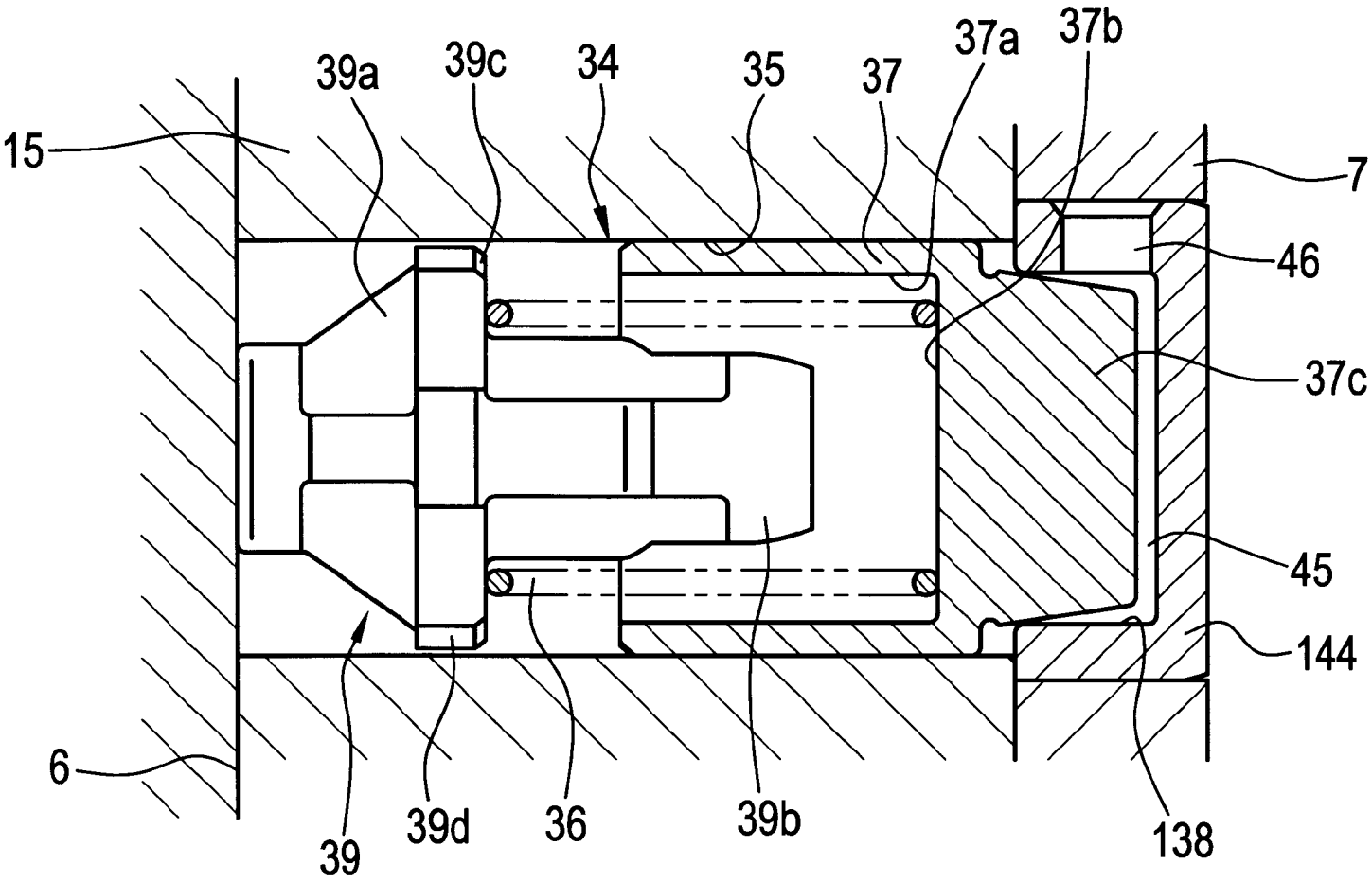
FIG. 6A is an enlarged sectional drawing, showing a locking member of the second embodiment of the present invention.
Figure 6B:
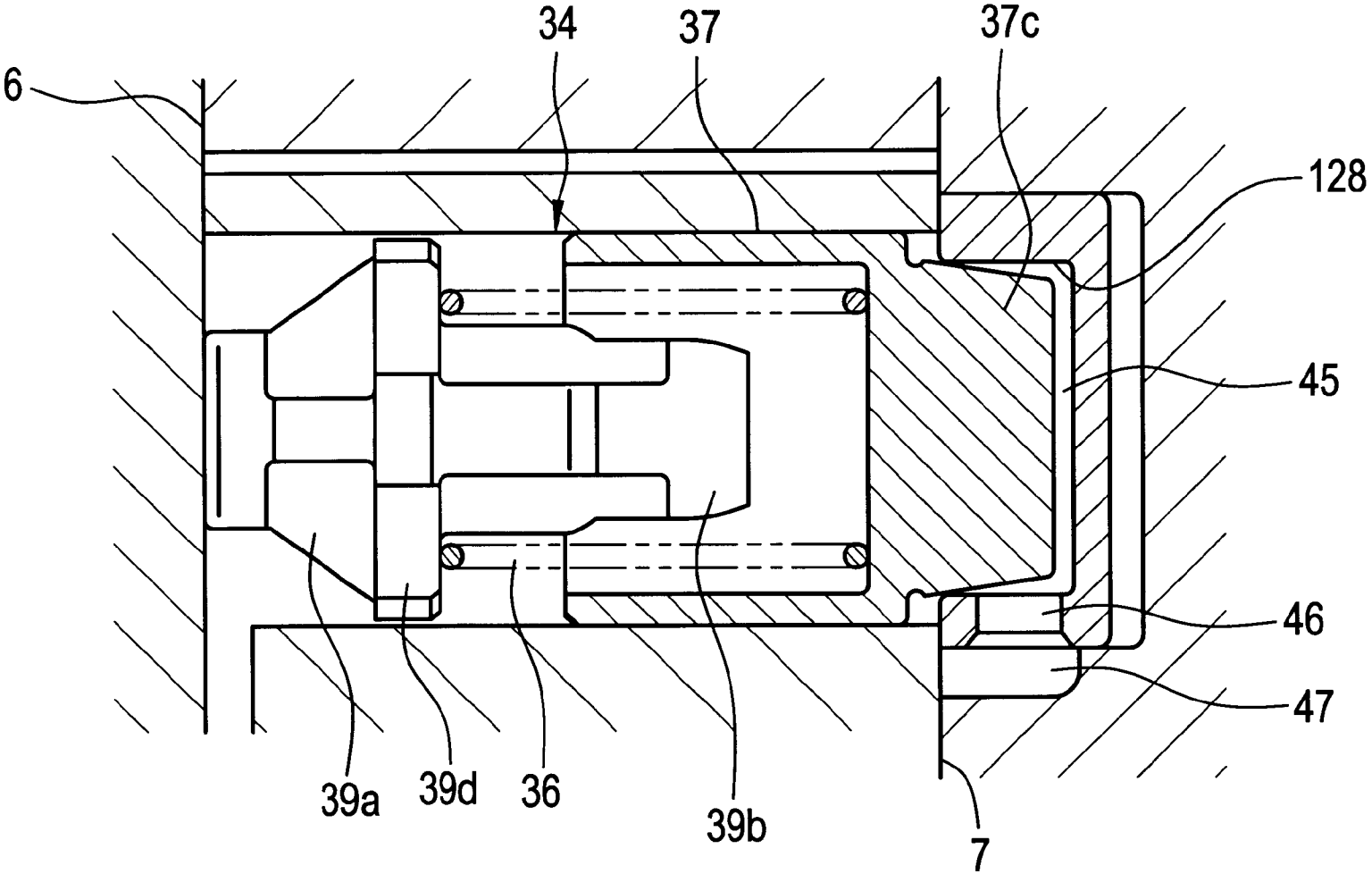
FIG. 6B is an enlarged sectional drawing, wherein the leading head portion of the locking member of FIG. 6A is accommodated in an engaging bore.
Figure 6C:
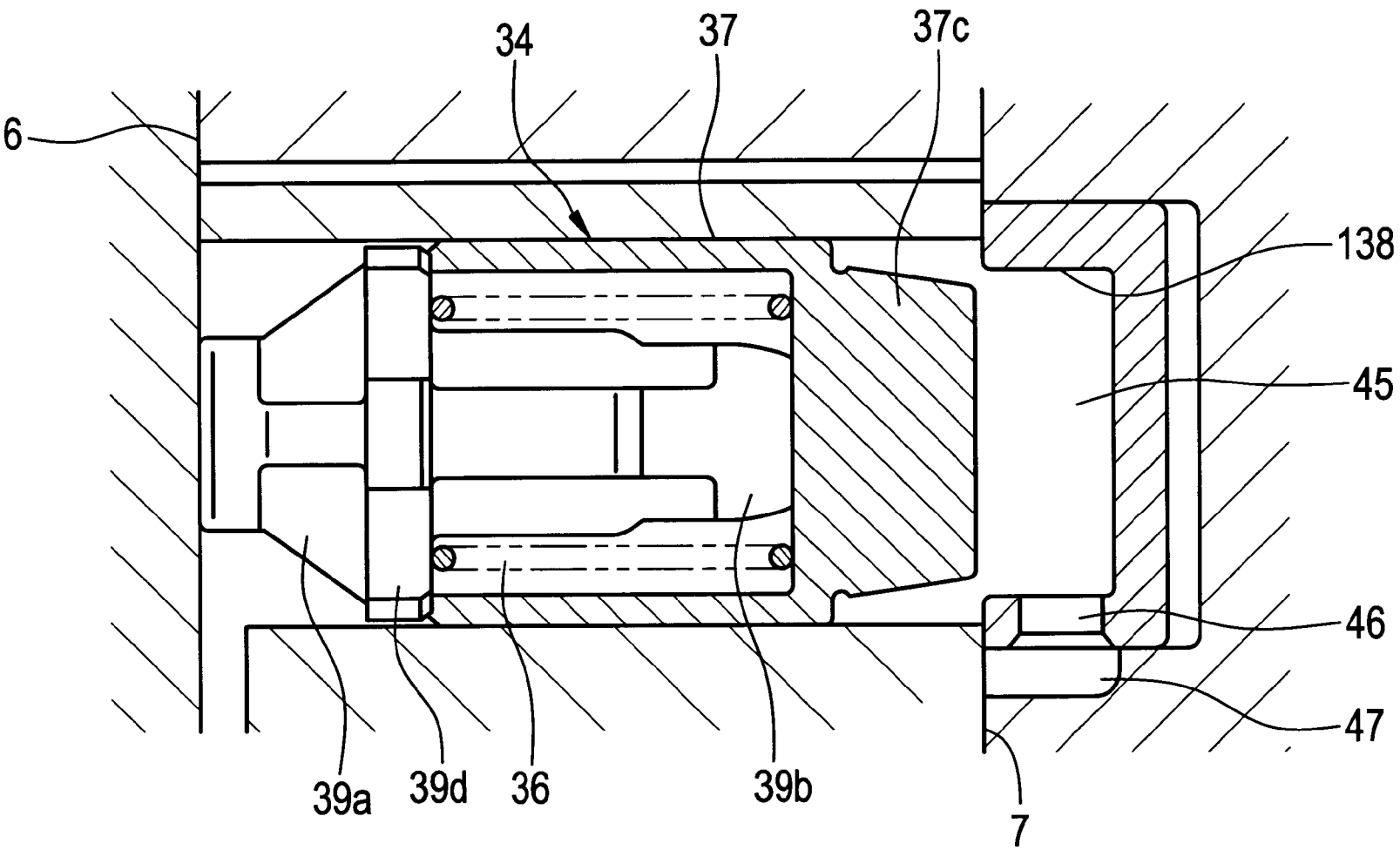
FIG. 6C is an enlarged sectional drawing, wherein the leading head portion of the locking member of FIG. 6A is retracted from an engaging bore.

In this embodiment, as shown in FIG. 6A, the engaging bore 38 is provided with tapered surface on the engaging member 44 in order that a diameter of the surface decreases toward the bottom surface of the engaging bore 38. A diameter at the opening surface of the engaging bore is larger than the diameter at the end face of the leading head portion 37*c* and smaller than a diameter at a position where the leading head portion 37*c* has the largest diameter. FIG. 6B shows a situation where the leading head portion 37*c* of the locking pin 37 is accommodated in the engaging bore 38. FIG. 6C shows a situation where the leading head portion 37*c* of the locking pin 37 is retracted from the engaging bore 38.

In the case where the tapered surface of the leading head portion 37*c* is provided with a certain taper angle at all portions of the leading head portion 37*c,* the leading head portion 37*c* makes contact with the engaging bore 38 at a locus of points of the leading head portion 37*c,* even if an uncertain taper angle is provided on the engaging bore. Therefore, the abrasion of the entire surface of the engaging bore 38, which causes undesirable retraction of the locking pin from the engaging bore 38, is prevented. Further, it is easy to provide the tapered surface on the engaging bore 38.

The present embodiments are to be considered as illustrative and not restrictive and the invention is not to be limited to the details given herein, but may be modified.

For example, while the embodiments of the present invention show that the intake camshaft 1 is subject to the variable valve timing control apparatus, an exhaust camshaft may also be controlled. In this case, the locking mechanism is provided at the most advanced position of the vane rotor 15 with respect to the housing member 4.

Another example, while the embodiments of the present invention show that the locking pin 37 and the engaging bore 44 are provided in the vane 18 and housing member 4, respectively, the locking pin 37 and the engaging member 44 may also be provided in the housing member 4 and vane 18, respectively.

Further example, while the embodiments of the present invention show that the locking pin 37 is provided in the vane 18, the locking pin 37 may also be provided in the vane rotor 15.

While the present invention is described on the basis of certain preferred embodiments, it is not limited thereto, but is defined by the appended claims as interpreted in accordance with applicable law.

This application relates to and incorporates herein by reference Japanese Patent application No. 2000-187427 filed on Jun. 22, 2000, from which priority is claimed.

What is claimed is:

1. A variable valve timing control apparatus for an internal combustion engine, comprising:

a housing member rotated in synchronism with one of a first shaft and a second shaft, said housing member comprising a circular space provided therein and at least one fan-shaped space radially extending from an outer circumferential surface of said circular space;

a vane rotor rotated in synchronism with the other of said first shaft and said second shaft and accommodated in said housing member in order to relatively rotate with respect to said housing member, said vane rotor comprising at least one vane radially extending so as to divide each said at least one fan-shaped space into a first chamber and a second chamber;

a locking member provided in one of said housing member and said vane, said locking member comprising a main body portion provided with a cylindrical shape and a leading head portion provided with a tapered surface whose diameter decreases toward an end face of the leading head portion, said locking member being movable in response to hydraulic pressure in said first hydraulic chamber or said second hydraulic chamber; and an engaging bore provided in the other of said housing member and said vane for accommodating said leading head portion, said engaging bore comprising an opening where said engaging bore receives said leading head portion, a diameter at the opening of said engaging bore being larger than a diameter at the end face of the leading head portion and smaller than a diameter at which the leading head portion has a largest diameter.

2. The apparatus according to claim 1, wherein said engaging bore is provided with cylindrical surface.

3. The apparatus according to claim 1, wherein said engaging bore is provided with tapered surface.

4. The apparatus according to claim 2, wherein said leading head portion and said engaging bore cooperatively define a third hydraulic chamber between said leading head portion and said engaging bore when said leading head portion is accommodated in said engaging bore, and further comprising:

a passage provided in said engaging bore, said passage connecting said third hydraulic chamber to one of said first hydraulic chamber and said second hydraulic chamber.

5. The apparatus according to claim 3, wherein said leading head portion and said engaging bore cooperatively define a third hydraulic chamber between said leading head portion and said engaging bore when said leading head portion is accommodated in said engaging bore, and further comprising:

a passage provided in said engaging bore, said passage connecting said third hydraulic chamber to one of said first hydraulic chamber and said second hydraulic chamber.

6. The apparatus according to claim 4, further comprising:

an engaging member provided on one of said housing and said vane, wherein said engaging bore is provided in said engaging member.

7. The apparatus according to claim 5, further comprising:

an engaging member provided on one of said housing and said vane, wherein said engaging bore is provided in said engaging member.

8. The apparatus according to claim 6, wherein said engaging member is made from high-strength steel having abrasion resistance.

9. The apparatus according to claim 7, wherein said engaging member is made from steel having abrasion resistance.

10. The apparatus according to claim 1, wherein said locking member further comprises a spring urging said leading head portion into said engaging bore.

11. A variable valve timing control apparatus for an internal combustion engine, comprising:

an intake camshaft for operating an intake valve, a housing member rotated in synchronism with a crankshaft, said housing member comprising a circular space provided therein and at least one fan-shaped space radially extending from an outer circumferential surface of said circular space;

a vane rotor rotated in synchronism with said intake camshaft and accommodated in said housing member in order to relatively rotate with respect to said housing member, said vane rotor comprising radially extending at least one vane so as to divide each said at least one fan-shaped space into a first chamber and a second chamber;

a locking member provided in said vane, said locking member comprising a main body portion provided with a cylindrical shape and a leading head portion provided with tapered surface whose diameter decreases toward an end face of the leading head portion, said locking member being movable in response to hydraulic pressure in said first hydraulic chamber or said second hydraulic chamber; and an engaging bore provided with a cylindrical surface and provided in said housing member for accommodating said leading head portion, said engaging bore comprising an opening where said engaging bore accommodates said leading head portion, a diameter at the opening of said engaging bore being larger than the diameter at the end face of the leading head portion and smaller than a diameter at which the leading head portion has a largest diameter.

12. The apparatus according to claim 11, wherein said leading head portion and said engaging bore cooperatively define a third hydraulic chamber between said leading head portion and said engaging bore when said leading head portion is accommodated in said engaging bore, and further comprising:

a passage provided in said engaging bore, said passage connecting said third hydraulic chamber to one of said first hydraulic chamber or said second hydraulic chamber.

13. The apparatus according to claim 12, further comprising:

an engaging member provided in one of said housing, wherein said engaging bore is provided in said cylindrical member, and wherein said engaging member is made from high-strength steel having abrasion resistance.

14. The apparatus according to claim 13, wherein said locking member further comprises a spring urging said leading head portion into said engaging bore.

15. A variable valve timing control apparatus for an internal combustion engine comprising:

an intake camshaft for operating an intake valve, a housing member rotated in synchronism with a crankshaft, said housing member comprising a circular space provided therein and at least one fan-shaped space radially extending from an outer circumferential surface of said circular space;

a vane rotor rotated in synchronism with said intake camshaft and accommodated in said housing member in order to relatively rotate with respect to said housing member, said vane rotor comprising radially extending at least one vane so as to divide each said at least one fan-shaped space into a first chamber and a second chamber;

a locking member provided in said vane, said locking member comprising a main body portion and a leading head portion provided with tapered surface whose diameter decreases toward an end face of the leading head portion, said locking member being movable in response to hydraulic pressure in said first hydraulic chamber or said second hydraulic chamber; and an engaging bore provided with a tapered surface and provided in said housing member for accommodating said leading head portion, said engaging bore comprising an opening where said engaging bore accommodates said leading head portion, a diameter at the opening of said engaging bore being larger than the diameter at the end face of the leading head portion and smaller than a diameter at which the leading head portion has a largest diameter.

16. The apparatus according to claim 1, wherein said locking member is movable within a bore, said bore having disposed therein a stopper member, said locking member engaging said stopper member to limit movement away from said engaging bore.

17. The apparatus according to claim 1, wherein said leading head portion and said engaging bore make contact along a locus of points.

18. The apparatus according to claim 15, wherein said locking member is movable within a bore, said bore having disposed therein a stopper member, said locking member engaging said stopper member to limit movement away from said engaging bore.

19. The apparatus according to claim 15, wherein said leading head portion and said engaging bore make contact along a locus of points.

20. A variable valve timing control apparatus for an internal combustion engine, comprising:

a housing member rotated in synchronism with one of a first shaft and a second shaft, said housing member comprising a circular space provided therein and at least one fan-shaped space radially extending from an outer circumferential surface of said circular space;

a vane rotor rotated in synchronism with the outer of said first shaft and said second shaft and accommodated in said housing member in order to relatively rotate with respect to said housing member, said vane rotor comprising at least one vane radially extending so as to divide each said at least one fan-shaped space into a first chamber and a second chamber;

a locking member provided in one of said housing member and said vane, said locking member comprising a main body portion provided with a cylindrical shape and a leading head portion provided with a tapered surface whose diameter decreases toward an end face of the leading head portion, said locking member being movable in response to hydraulic pressure in said first hydraulic chamber or said second hydraulic chamber; and an engaging bore provided in the other of said housing member and said vane for accommodating said leading head portion, said engaging bore comprising an opening where said engaging bore receives said leading head portion, a diameter at the opening of said engaging bore being larger than a diameter at the end face of the leading head portion and smaller than a diameter at which the leading head portion has a largest diameter, said engaging bore has a tapered surface whose diameter increases toward an opening, an angle of said tapered surface of said engaging bore being smaller than an angle of said tapered surface of said leading head portion.

21. The apparatus according to claim 20, wherein said leading head portion and said engaging bore make contact along a locus of points.

* * * * *